United States Patent [19]

Hampton

[11] 4,046,076

[45] Sept. 6, 1977

[54] IMPULSIVE ROCKET MOTOR SAFETY-ARMING DEVICE

[75] Inventor: Thomas W. Hampton, China Lake, Calif.

[73] Assignee: The United States of America as represented by the Secretary of the Navy, Washington, D.C.

[21] Appl. No.: 617,568

[22] Filed: Sept. 29, 1975

[51] Int. Cl.[2] ..... F42C 19/08

[52] U.S. Cl. ..... 102/70.2 A; 102/49.7; 60/39.82 E; 89/1.814

[58] Field of Search ..... 89/1.814, 1.812, 1.813, 89/1.807; 102/49.7, 70.2 A, 70.2 R, 49.7; 60/39.82 E, 256, 39.09 R, 39.11

[56] References Cited

U.S. PATENT DOCUMENTS

| | | | |
|---|---|---|---|
| 3,111,810 | 11/1963 | Branman et al. | 60/39.82 E X |
| 3,319,566 | 5/1967 | Choate et al. | 102/49.7 |
| 3,421,410 | 1/1969 | Kayaian | 89/1.807 |
| 3,423,931 | 1/1969 | Schwarz et al. | 60/39.47 |
| 3,500,747 | 3/1970 | Parker | 102/70.2 R |
| 3,529,418 | 9/1970 | Puckett et al. | 60/256 X |
| 3,714,863 | 2/1973 | Sindall | 89/1.812 X |
| 3,785,150 | 1/1974 | Katcher | 102/49.7 X |

*Primary Examiner*—David H. Brown
*Attorney, Agent, or Firm*—R. S. Sciascia; Roy Miller; Thomas W. Hennen

[57] ABSTRACT

An impulsive safety-arming device provides handling safety in a rocket motor. Prior to arming, a piston is blocked in position to contain a squib, thereby preventing inadvertent ignition. After arming, the piston block is removed allowing high temperature, high pressure gas from the squib to force the piston past vent ports and to escape and ignite the motor.

16 Claims, 3 Drawing Figures

IMPULSIVE ROCKET MOTOR SAFETY-ARMING DEVICE

BACKGROUND OF THE INVENTION

This invention relates to safety-arming devices for rocket motors wherein an electro-initiator device (EID) is used to ignite a booster charge of pyrotechnic material which in turn ignites the rocket propellant. More particularly, this invention relates to such devices which will prevent rocket motor ignition by containing premature EID combustion, and which utilize energy from the properly ignited EID to remove an ignition barrier between the EID and the booster charge.

Rocket motors of the type used in guided missiles which are launched from surface or airborne platforms use a variety of devices for preventing unintentional rocket motor ignition. One class of such devices uses an EID aligned with a booster charge in the rocket motor and rendered safe by electric switches, electronic filters, electrically insensitive bridgewires or by a combination of such elements. Another class of similar devices utilizes a barrier between the EID and the booster charge. When rocket motor ignition is likely to be desired, the barrier is removed manually by external means.

These designs are not sufficiently fail-safe to be stored in quantity in the assembled condition and thus must have the EID installed just prior to use. Also it is possible for inexperienced personnel to improperly arm the rockets thereby making them impossible to launch, or to unintentionally store rockets in the armed condition with other unarmed rockets and thus create an unreasonable danger of explosion. Further, freedom of missile design is somewhat restricted if a provision must be made for installation of an EID prior to use. The missile must have an access port for EID installation and therefore will result in a more complex structure than if the EID is permanently installed deep within the missile.

SUMMARY OF THE INVENTION

The safety-arming device of the present invention uses a sealed piston sliding within a vented outer housing. An electrically initiated squib device (EID) is placed within the piston and is sealed against leakage so that when the squib is ignited, it produces a large quantity of high temperature, high pressure gas which drives the piston to the opposite end of the outer housing. The EID, piston and seal remain intact after ignition to prevent leakage so that the gas pressure may act on the piston rather than escape through the piston to the interior of the safety-arming device. The piston uncovers a plurality of vents as it travels. High temperature, high pressure gas confined within the housing by the piston escapes through the uncovered vents and ignites a pyrotechnic booster charge which ignites the rocket motor propellant.

A mechanical blocking member is positioned to forcibly retain the piston in its initial position covering all housing vents. This blocking member has sufficient strength to withstand the force on the piston caused by gas pressure from the squib if the squib is ignited unintentionally or prematurely.

A step motor aligned axially with the blocking member rotates the blocking member ninety degrees from a safety position in which piston travel is prevented, to an armed position in which piston travel is possible. This motor is controlled by externally generated signals which precede an intentional launch.

If the squib is ignited when the blocking member is in the safety position the high pressure gas produced by the squib is contained by the outer housing and piston, and ignition of the rocket motor is prevented. An added safeguard against premature or unintentional rocket motor ignition is the electric current supply circuit to the squib. This circuit employs electrical contacts which are only closed when the blocking member is rotated to the armed position.

BRIEF DESCRIPTION OF THE DRAWINGS

Further advantages of the present invention will emerge from a description which follows of a possible embodiment of a safety-arming device according to the invention, given with reference to the accompanying drawings, in which.

DESCRIPTION OF THE PREFERRED EMBODIMENT

Figure 1:
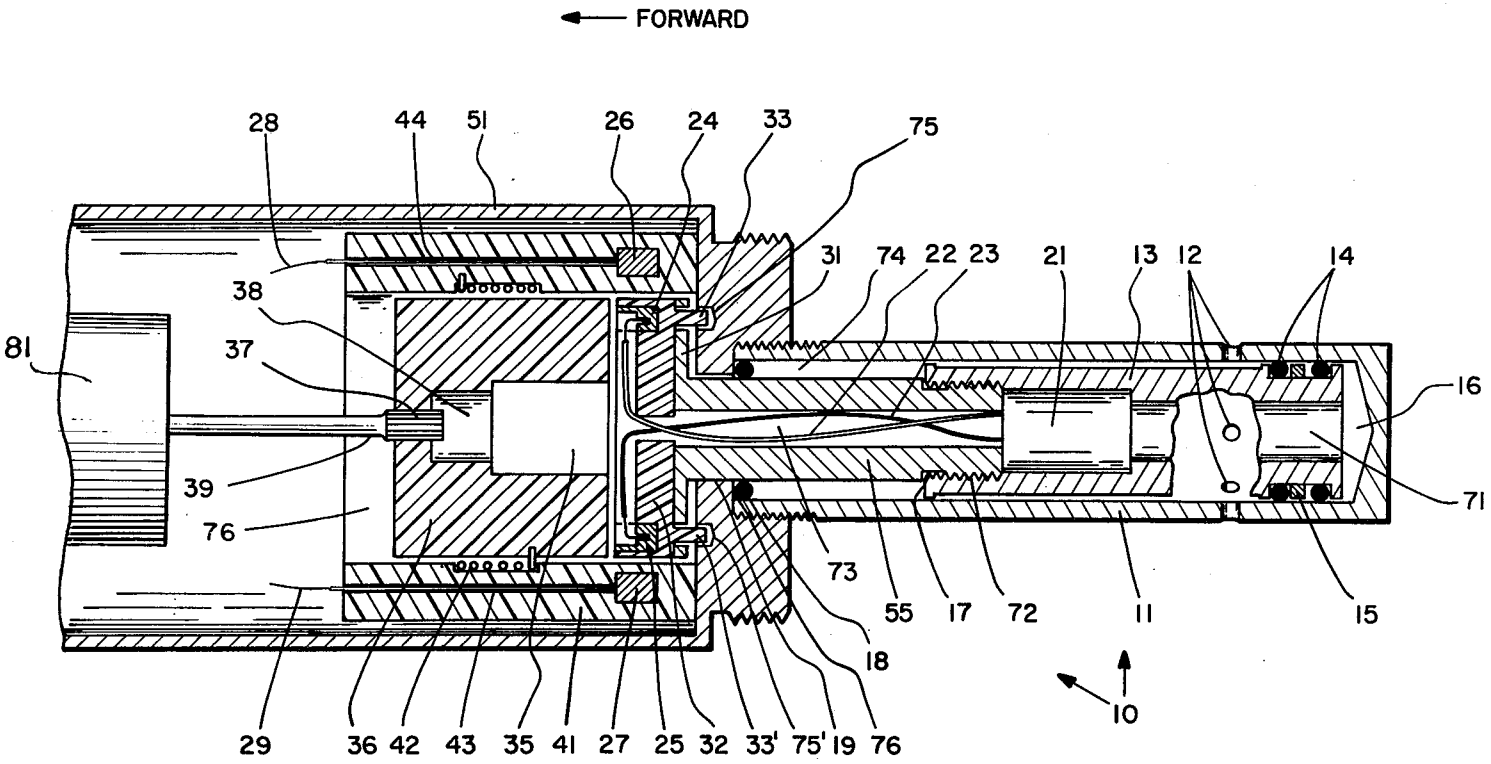
FIG. 1 is a longitudinal sectional view of a safety-arming device in the safety position.

Referring now to the drawings wherein like reference numerals correspond to like parts and elements throughout the several figures there is shown in FIG. 1 elongated cylindrical housing 11 equipped with a plurality of vent ports 12. Within housing 11 resides hollow piston 13 and piston base 55. Piston 13 is sealed against the inner surface of housing 11 in housing cavity 16 by resilient o-rings 14 which encircle piston 13. O-rings 14 are separated by resilient separator 15. Hollow piston 13 has a centrally bored stepped hole 71 which retains electro-initiator squib 21 against threaded end 72 of piston base 55. Electrical lead-in wires 22 and 23 from squib 21 lead through central cavity 73 of piston base 55 and are firmly attached to electrical contacts 24 and 25 on piston base isolation member 32. Elongated cylindrical housing 11 is firmly attached to main housing 51 by any appropriate means. FIG. 1 illustrates elongated cylindrical housing 11 being threaded into main housing 51, but it is to be understood that other fastening means will work as well. Piston base isolation member 32 is retained to piston base 55 by being cemented to piston base flange 31. Piston base isolation member 32 has projections 33, 33' which penetrate piston base flange 31 and engage shallow holes 75, 75' in housing 51, thereby preventing relative rotation between piston base isolation member 32 and main housing 51.

Figure 2:
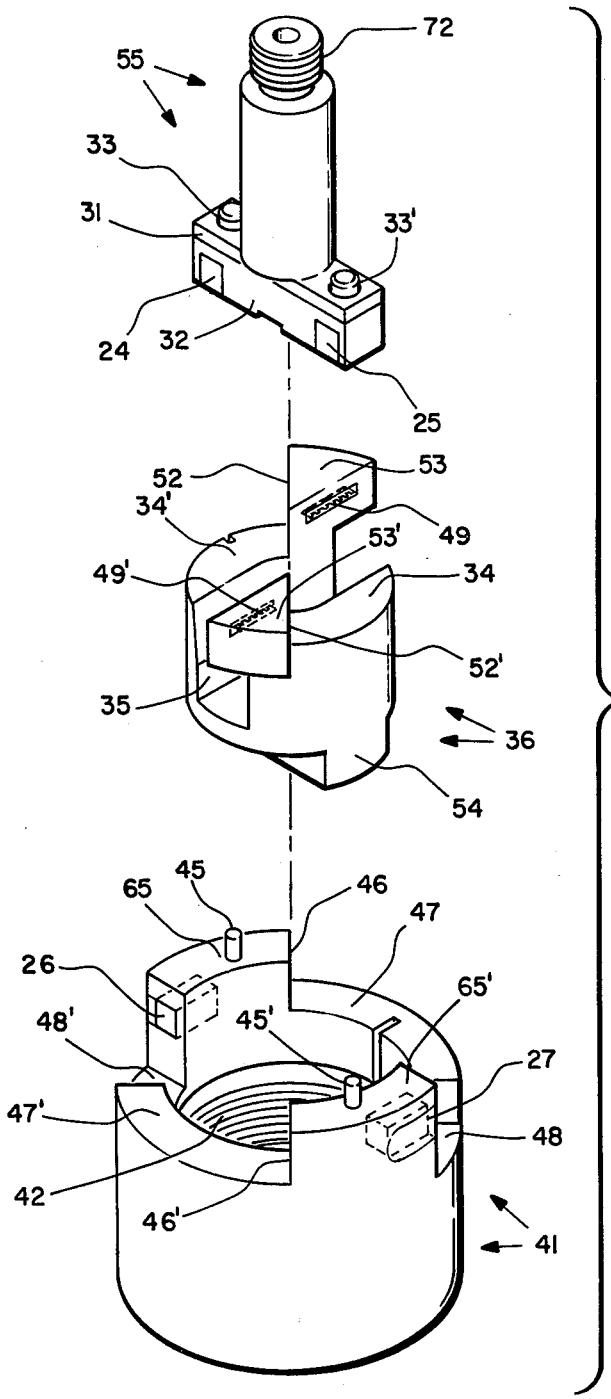
FIG. 2 is a perspective exploded view of the blocking member and piston base according to the invention.

Within main housing 51 is contained stationary blocking member 41 which is rigidly retained within housing 51 and braced against relative rotation by pins 45, 45' as shown in FIG. 2 which project into holes in main housing 51. Within stationary blocking member 41 is rotational blocking member 36 which is free to rotate through a predetermined angular displacement within central bore 76 of stationary blocking member 41. Rotational blocking member 36 has central receiving cavity 35 shown in FIG. 1 positioned ninety degrees to the longitudinal direction of piston base isolation member 32. This relative orientation corresponds to the safety-arming device being in the safety position. Rotational blocking member 36 is retained within stationary blocking member 41 be ears 53, 53' which abut sliding surfaces 47, 47' on stationary blocking member 41. Recesses 48, 48' in the side of stationary blocking member 41 provide room for ears 53, 53′ to enter when piston base 55 and piston base isolation member 32 are forced by gas pressure in housing cavity 16 to enter central receiving cavity 35 in rotational blocking member 36.

When rotational blocking member 36 has been rotated to the armed position by shaft 39 which is powered by electric motor 81, in response to a first externally generated signal, piston base isolation member 32 no longer bears against blocking surfaces 34, 34′ and is able to enter central receiving cavity 35. When squib 21 is ignited, piston base isolation member 32 bottoms in receiving cavity 35 and forces rotational blocking member 36 forward on splines 37 of shaft 39. Rotational blocking member 36 disengages splines 37 and frees shaft 39 for other functions. Splines 37 then enter enlarged hole 38.

Rotational blocking member 36 is also restrained by a supporting member, now shown, which bears against tang 54 on rotational blocking member 36 and prevents axial motion when rotational blocking member 36 is in the safety position. This supporting member allows axial motion only when rotational blocking member 36 is rotated to the armed position, thereby aligning tang 54 with a receiving cavity, not shown, in the supporting member. This supporting member is rigidly attached to housing 51 and occupies space adjacent blocking members 36 and 41 in the region forward of central bore 76.

Torsional coil spring 42 engages both stationary and rotational blocking members 41 and 36 and produces a relative torque which urges ear contact surfaces 52, 52′ against stop contact surfaces 46, 46′ on stationary blocking member 41 thereby yieldingly retaining rotational blocking member 36 in the safety position.

Stationary blocking member 41 has electrodes 26 and 27 embedded in stops 65, 65′ which are supplied with electric current by lead-in wires 28 and 29. Lead-in wires 28 and 29 follow lead-in paths 43 and 44 to electrodes 26 and 27. As shown in FIG. 1, electrodes 26 and 27 are positioned adjacent electrical contacts 24 and 25 on piston base isolation member 32. Electrical contact bridging members 49, 49′ on ears 53, 53′ electrically bridge between electrodes 26 and 27, and electrical contacts 24 and 25, respectively when rotational blocking member 36 is rotated to the armed position. When rotational blocking member 36 is rotated to the safety position electrical contact bridging members 49, 49′ are separated from electrodes 26 and 27 and electrical contacts 24 and 25 so that no continuity exists in the circuit supplying firing energy to electro-initiator squib 21.

Piston base 55 and piston 13 are connected by screw threads at 72 to allow disassembly so that piston base 55 may be inserted through main housing 51 at close fitting hole 19. During the assembly process, piston base 55 is cemented to piston 13 over the area of threads at 72 with an epoxy sealant to prevent piston base 55 from disengaging piston 13 and also to prevent possible gas leakage past the threaded area at 72.

Figure 3:
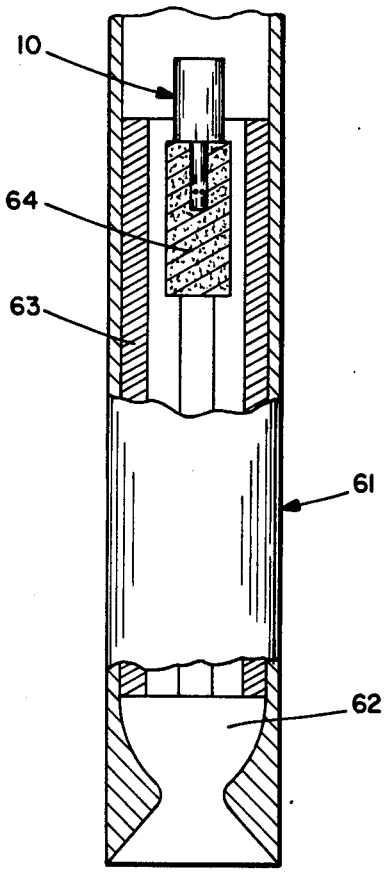
FIG. 3 is a partially cut away sectional view of the invention within a rocket motor.

Main housing 51 and attached elongated cylindrical housing 11, together making up safety-arming assembly 10, are installed in missile 61 near the head end of combustion chamber 62 as shown in FIG. 3. In normal operation within a missile, when missile launch is desired, rotational blocking member 36 is rotated to the armed position and squib 21 is electrically ignited. Gas pressure in housing cavity 16 presses against piston 13 and forces piston base 55 into central receiving cavity 35 in rotational blocking member 36. At this time shoulder 17 moves through space 74 and compresses o-ring 18 against main housing shoulder 76. Gas escaping from vent ports 12 ignites pyrotechnic material in canister 64 and in a very short period of time completely fills combustion chamber 62 with a high temperature high pressure gas which uniformly ignites the exposed surfaces of solid propellant 63. As pressure in combustion chamber 62 increases, piston 13 at shoulder 17 compresses o-ring 18 with still greater force thereby producing an even tighter obturating seal.

Obviously many modifications and variations of the present invention are possible in the light of the above teachings. It is therefore to be understood that within the scope of the appended claims the invention may be practiced otherwise than as specifically described.

What is claimed is:

1. An impulsive safety-arming device for preventing unintentional ignition of a rocket motor, comprising:
   - a housing defining a plurality of vent ports;
   - a piston retained within said housing and constrained to motion between first and second piston positions;
   - resilient sealing means retained between said piston and said housing;
   - said piston, housing, and resilient sealing means defining a confined volume characterized by said piston being in said first piston position;
   - said resilient sealing means being positioned to enable fluid communication between said confined volume and said vent ports when said piston is in said second piston position;
   - piston blocking means positionable to forcibly retain said piston in said first piston position, retained within said housing;
   - means for moving said piston blocking means from said retaining position, said moving means engaging said piston blocking means and being responsive to a first externally generated signal;
   - and means for generating fluid pressure within said confined volume, said fluid pressure generation means being responsive to a second externally generated signal.

2. The impulsive safety-arming device of claim 1 wherein:
   - said housing is an elongated right circular cylinder having two ends and a central bore closed at one end, and said plurality of vent ports are spaced from said closed end said communicate between said central bore and the exterior of said cylinder; and
   - said piston is a cylindrical tube having first and second ends, a narrow recess formed circumferentially about said piston at said first end, and adapted to sealingly retain an electrically initiated squib within said tube.

3. The impulsive safety-arming device of claim 2 in combination with a canister containing a pyrotechnic material, both securely mounted within a rocket motor combustion chamber, and said safety-arming device being retained in intimate contact with said pyrotechnic material.

4. The impulsive safety-arming device of claim 2 in combination with a canister containing a pyrotechnic material, both said device and said canister being securely mounted within a rocket motor combustion chamber, and said safety-arming device being retained in intimate contact with said pyrotechnic material.

5. The impulsive safety-arming device of claim 4 wherein said piston has an elongated region of reduced diameter bounded by shoulders of increased diameter, said region spaced from said narrow recess, and said region penetrating a like diamter hole in said housing, said piston being constrained thereby to move between said first and second piston positions.

6. The impulsive safety-arming device of claim 5 wherein an elastic ring encircles said piston in said region of reduced diameter and forms a gas tight obturating seal between said housing an one of said shoulders on said piston when said piston is in said second piston position.

7. An impulsive safety-arming device for enabling safe storage and handling of a rocket motor, comprising:

a housing defining a plurality of vent ports;

a piston sealingly retained within said housing and constrained to motion between first and second piston positions;

said piston and housing defining a confined volume characterized by said piston being in said first piston position;

said plurality of vent ports being positioned to enable fluid communication between said confined volume, and the exterior of said housing when said piston is in said second piston position;

piston blocking means retained within said housing and movable between first and second blocking positions for forcibly retaining said piston in said first piston position when said piston blocking means are in said first blocking position;

means engaging said piston blocking means for moving said piston blocking means from said first blocking position to said second blocking position in response to a first externally generated signal; and means associated with said confined volume for generating fluid pressure within said confined volume in response to a second externally generated signal.

8. The impulsive safety-arming device of claim 7 wherein said fluid pressure generating means comprises an electrically initiated gas generating squib.

9. The impulsive safety-arming device of claim 8 wherein electrical contact means are attached to and cooperate with said piston blocking means and said piston for establishing a continuous electrical circuit between an external signal source and said electrically initiated squib when said piston blocking means is in said second blocking position.

10. The impulsive safety-arming device of claim 9 wherein said piston blocking means has inner and outer members:

said outer member having a central bore, first and second ends, said first end defining a plurality of stops, and having at least one electrode forming part of an electrical contact at said first end, said outer member being rigidly attached to said housing;

and said inner member coextensively occupying said central bore in said outer member, having projections which constrain said inner member to limited angular rotation between first and second rotational positions and to longitudinal travel only at preselected relative rotational positions by contacting said plurality of stops on said outer member, and having bridging electrodes on said projections for completing electrical continuity from said electrode on said outer member to said electrical contact means on said piston;

said inner member also having a cavity of receiving said piston when said inner member is in said second rotational position, and blocking surface adjacent said receiving cavity for forcibly retaining said piston in said first piston position when said inner member is in said first rotational position, and wherein said piston blocking means has resilient means for urging projections on said inner member rotatably against said stops on said outer member, said inner member being yieldingly retained thereby in said first rotational position.

11. The impulsive safety-arming device of claim 10 wherein:

said inner member has a centrally located splined hole for accepting a splined shaft, and said means for moving said piston blocking means is an electric motor having a splined shaft engaging said splined hole in said inner member for rotating said inner member from said first rotational position to said second rotational position in response to said first externally generated signal.

12. An impulsive safety-arming device for enabling safe storage and handling as well as for providing reliable ignition of a rocket motor, comprising:

a gas generator;

a container surrounding said gas generator for containing gas produced by said gas generator; and condition responsive means associated with said container for causing said container to fail to contain said gas in response to predetermined conditions.

13. An impulsive safety-arming device as set forth in claim 12 wherein said gas generator comprises an electrically initiated squib.

14. An impulsive safety-arming device as set forth in claim 12 wherein said predetermined conditions include reception by said condition responsive means of a first externally generated signal.

15. An impulsive safety-arming device as set forth in claim 12 wherein said container comprises:

a housing;

a piston sealingly retained within said housing and movable between first and second piston positions; and piston blocking means associated with said housing and movable between first and second blocking positions.

16. An impulsive safety-arming device as set forth in claim 15 wherein said condition responsive means comprises:

said housing having a plurality of vent ports;

said piston and having defining a confined volume characterized by said piston being in said first piston position;

said piston being blocked in said first position by said piston blocking means being in said first blocking position, and said piston being unblocked by said piston blocking means being in said second blocking position; and means associated with said housing for moving said piston blocking means from said first blocking position to said second blocking position.

* * * * *